US009567768B1

(12) United States Patent
Galla

(10) Patent No.: US 9,567,768 B1
(45) Date of Patent: Feb. 14, 2017

(54) SAFETY NET SYSTEM INCLUDING APPARATUS FOR SECURING

(71) Applicant: Paul V. Galla, Erie, PA (US)

(72) Inventor: Paul V. Galla, Erie, PA (US)

( * ) Notice: Subject to any disclaimer, the term of this patent is extended or adjusted under 35 U.S.C. 154(b) by 881 days.

(21) Appl. No.: 13/940,676

(22) Filed: Jul. 12, 2013

(51) Int. Cl.
*E04G 21/32* (2006.01)
*E04H 17/00* (2006.01)

(52) U.S. Cl.
CPC ..... *E04H 17/00* (2013.01)

(58) Field of Classification Search
CPC ..... E04H 17/02; E04H 17/04; E04H 17/06; E04H 17/08; E04H 17/10; E04G 21/32; E04G 21/3223; E04G 5/001; E04G 2005/148; E01F 7/00; E01F 7/02; E01F 7/04; E01F 7/045; E01F 13/00; E01F 13/022; E01F 13/024; E01F 13/028
See application file for complete search history.

(56) References Cited

U.S. PATENT DOCUMENTS 3,936,914 A * 2/1976 Mancini ..... A44B 11/2588 24/684
4,222,609 A * 9/1980 Andersson ..... B60R 22/18 16/261
5,458,447 A * 10/1995 Clason ..... B60P 7/135 410/100
5,671,948 A * 9/1997 Susko ..... B60R 22/26 280/801.1
6,776,260 B2 * 8/2004 Cjepa ..... E04G 21/3204 182/137
7,566,047 B2 * 7/2009 Wall ..... A01K 3/00 256/32
2004/0135134 A1 * 7/2004 Rice ..... E04G 21/3223 256/32
2008/0173854 A1 * 7/2008 Meaux ..... E01F 13/02 256/23

* cited by examiner

*Primary Examiner* — Michael P Ferguson
(74) *Attorney, Agent, or Firm* — Richard K Thomson

(57) ABSTRACT

A safety net system includes a mesh netting, first and second fixed support which are positioned either side of a loading dock or other dangerous zone. Clips secured to the mesh netting interact with connectors affixed to the fixed supports to place the netting in blocking position. An adjustable height stanchion is used as the fixed support in one embodiment.

11 Claims, 5 Drawing Sheets

SAFETY NET SYSTEM INCLUDING APPARATUS FOR SECURING

This application claims priority benefit of provisional pat. appl. Ser. No. 61/713,790 filed Oct. 14, 2012.

BACKGROUND AND SUMMARY OF THE INVENTION

The present invention is directed to the field of safety devices. More particularly, the present invention is directed to a safety net system and mounting bracket and stanchion therefor to prevent unwary workmen from stepping/riding off the loading dock of an open overhead door or entering other unsafe areas unaware.

A variety of gates, guards, and netting devices have been devised to limit unwary access to the precipice formed by the end of a loading bay dock when the door is opened. The present invention is directed to a safety net system and mounting bracket system which affords an effective, yet simple method, of preventing work-related injuries resulting from workmen and visitors to a warehouse from stepping off the end of a dock, into an open, uncovered pit, area under repair, or the like.

The safety net of the present invention is designed to block ingress/egress to a dangerous area to prevent someone from accidently driving/walking into such an area unaware and incurring an injury. The safety net system of the present invention may also be used to prevent injury by limiting access to any of a number of other dangerous areas including, but not limited to oil changing pits, poorly lit stairs, high-traffic areas in a warehouse, etc. A point of novelty of the present invention resides in the unique configuration of the brackets which include a first primary bracket for attachment to the door rail that has a first acute included angle and a pair of protruding ears that receive a secondary removable bracket which has a 90° included angle and a flange which is bent at a second acute angle which exceeds the first acute angle. The secondary bracket fits between the two protruding ears of the primary bracket. The two brackets engage to form a right angle to hold the safety net across the open doorway. A third smaller secondary bracket accommodates smaller sized nets.

A second point of novelty lies in the ease with which the safety net system may be deployed to prevent, and removed to permit, access to these various danger zones.

A second embodiment of mounting bracket, rather than being secured to the sometimes flimsy, flexible overhead door rail, is more robust and is anchored directly to the wall of the building. This reduces the undesired give in the bracket system and, hence, in the safety net system.

Yet another feature of the present invention includes a mounting stanchion which includes a stationary base and an upper post which is height adjustable thereon and, by virtue of its telescoping design, can have the upper length readily removed to permit wide cargos to pass over the base for presentation to the loading dock or reception therefrom.

The safety net system of the present invention for limiting pedestrian and vehicular traffic to a dangerous area, said safety net system comprises: a) a first fixed support positioned adjacent a first side of the dangerous area, the first fixed support having a first group of connectors attached thereto; b) a second fixed support positioned adjacent a second side of the dangerous area, the second fixed support having a second group of connectors attached thereto; c) a removable mesh net extendable between the first fixed support and the second fixed support, the removable mesh net having a first series of clips engagable with the first group of connectors and a second series of clips engagable with the second group of connectors to limit access to the dangerous area and prevent unwary pedestrians and vehicle drivers from possibly being injured.

The removable mesh net comprises orthogonal woven horizontal and vertical strap members and the first group of clips are each secured to one of a first series of strap extensions protruding laterally from a first edge of the removable mesh net and the second group of clips are each secured to one of a second series of strap extensions protruding laterally from a second opposite edge of the removable mesh net. Preferably, in one embodiment, a length of each of the first and second series of strap extensions is adjustable. Each of the first group of connectors comprises a first bracket having a first planar portion and a second planar portion forming an angle $\alpha$ with the first planar portion. In one embodiment, the first planar portion includes a plurality of attachment openings for securing the first bracket to the first fixed support. In an alternate embodiment, each of the first group of connectors further comprises a third planar portion positioned at an opposite end of the first planar portion from the second planar portion, the third planar portion extending orthogonally from the first planar portion. This second embodiment further comprising a stabilization bar welded at each end to said first planar portion and said third planar portion. A plurality of attachment openings are formed in the third planar portion for securing the first bracket to the fixed support.

In one embodiment, each clip of the first group of clips comprises a first planar member, a second orthogonal arm member, and a third angulated member wherein the third angulated member forms an angle $\alpha$ with the second orthogonal arm member, whereby when one of the first group of clips is engaged with one of the first group of connectors, the first planar member of the clip lies in an orthogonal orientation relative to the first planar portion of the connector. Each of the first group of connectors further comprises a pair of ears protruding outwardly from the second orthogonal member, the pair of ears serving to stabilize the clip when the clip is engaged with the connector. Each of the first and second fixed supports comprise an adjustable stanchion including a first base member with an upwardly extending stump portion and a removable upper post which telescopes over the stump portion.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
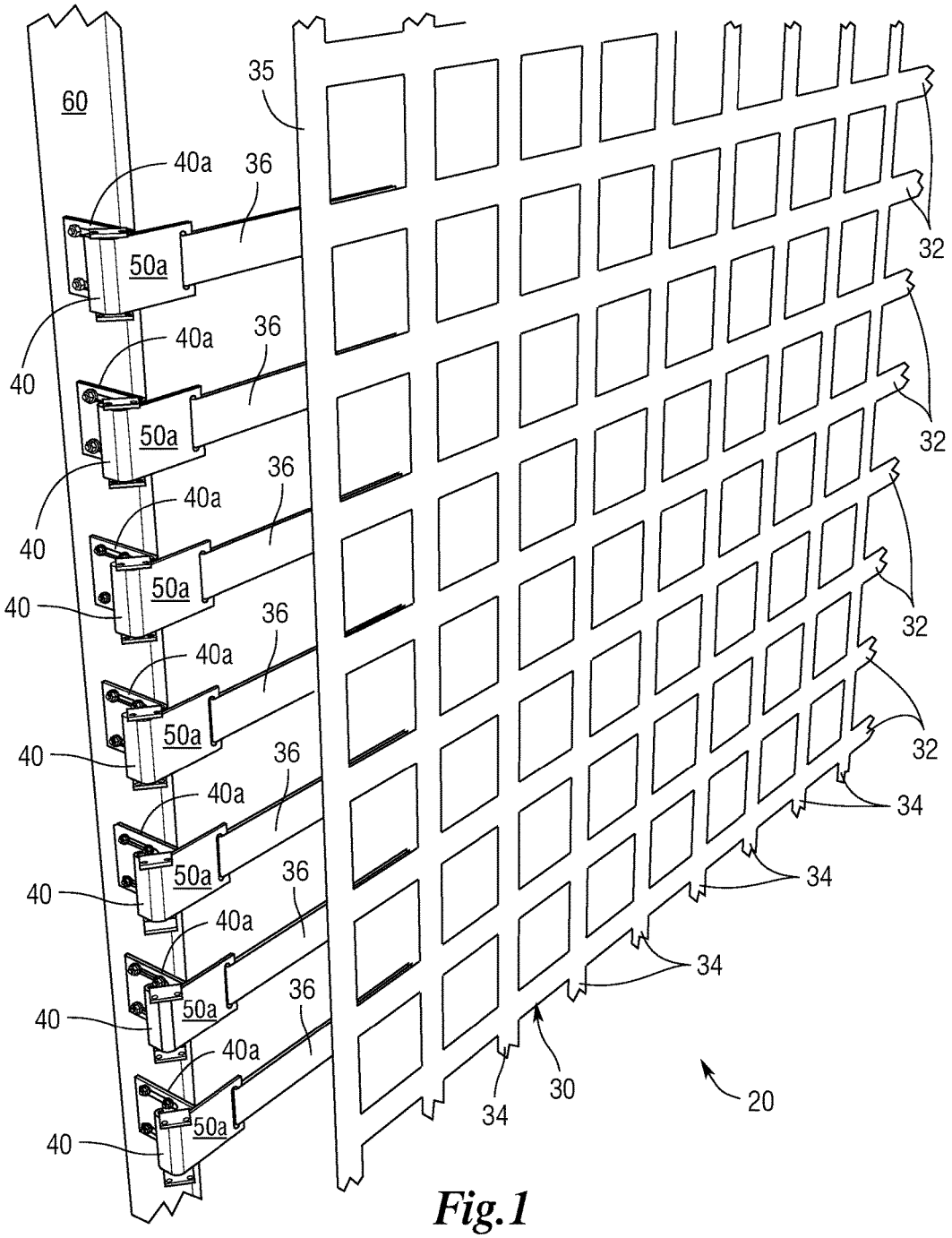
FIG. 1 is a partial perspective front view of a first embodiment of the safety net system of the present invention.
Figure 10:
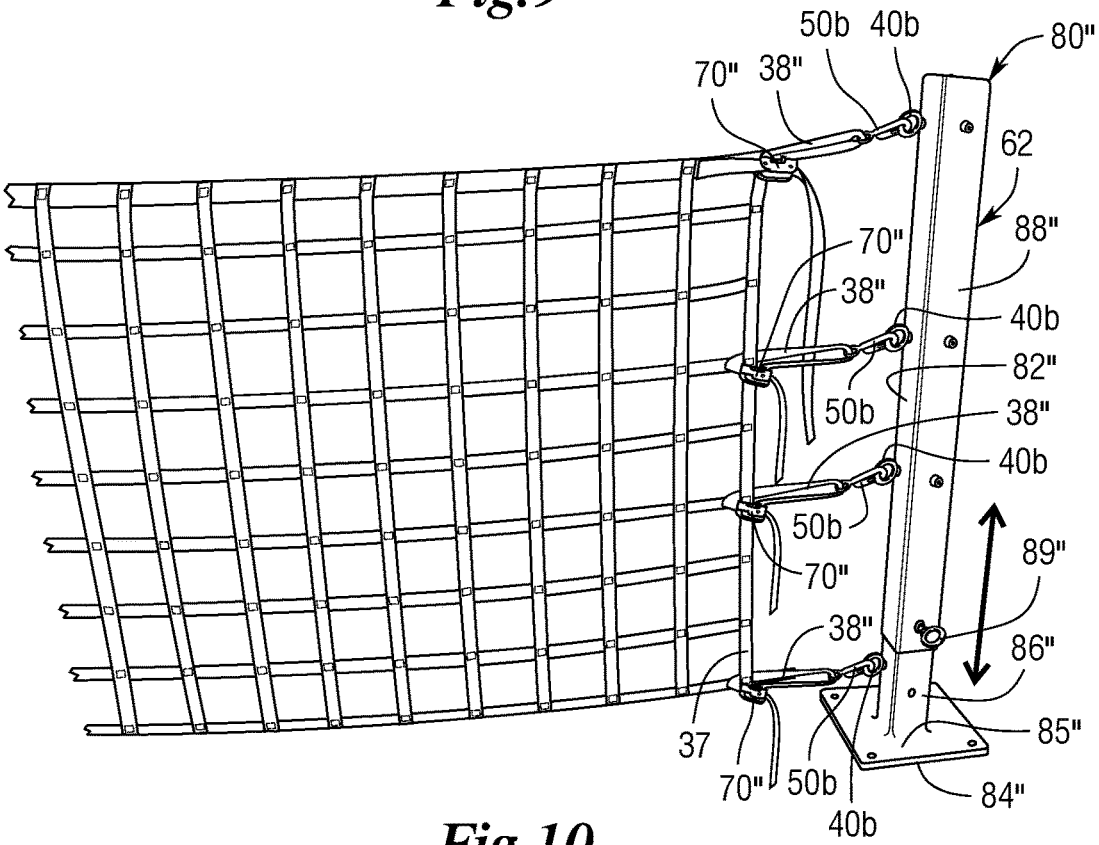

A first embodiment of the safety net system of the present invention is depicted in FIG. 1 generally at 20. Safety net system 20 includes a mesh safety net 30, first (60) and second (62) fixed supports positioned on each side of the dangerous region, and attachment means 40 for securing safety net 30 to fixed supports 60, 62. Mesh safety net 30 is made up of horizontal strap members 32 and vertical strap members 34. At least some, and, in the first embodiment, preferably each, of the horizontal strap members 32 along first peripheral edge 35 of net 30 are formed with a first series of horizontal extensions 36 and horizontal strap members 32 on opposite peripheral edge 37 are formed with a second series 38 of horizontal extensions (FIG. 10). Horizontal strap members 32 and vertical strap members are preferably woven fabric strips which are stitched together at their junctions, although other attachment techniques may be utilized without departing from the scope of the invention. The fabric of straps 32 and 34 may be cotton, polyester, nylon, polypropylene, UHMWPE, or aramid fibers, as the particular application warrants.

First fixed support 60 has a first group of connectors 40*a* and the second fixed support 62 having a second group of connectors 40*b*. The and first and second series of clips 50*a* and 50*b* are engagable with first and second groups of connectors 40*a*, 40*b*, respectively. In the first embodiment depicted in FIG. 1, first and second series of clips 50*a*, 50*b* are attached to the ends of horizontal extensions 36 and 38, respectively as by a stitched loop reversed through slots 52 formed therein for this purpose.

Figure 2:
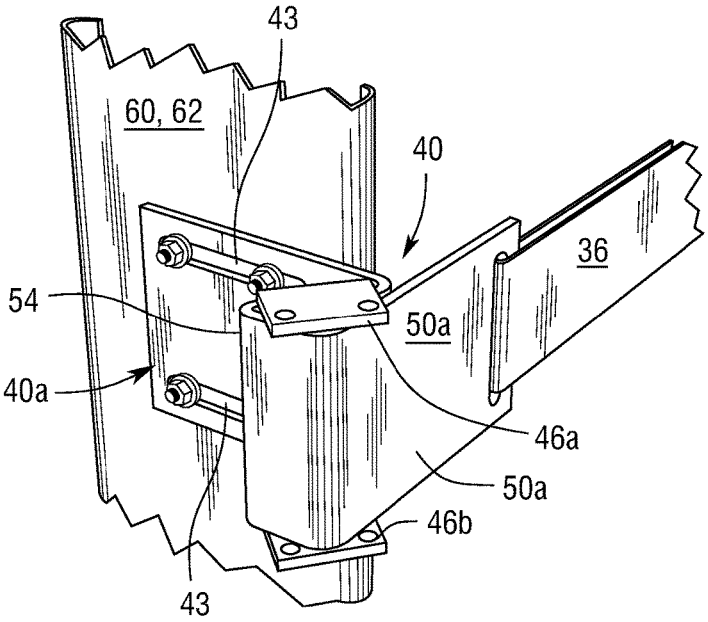
FIG. 2 is a front perspective view showing both halves of a first embodiment of securement bracket of the present invention.
Figure 3:
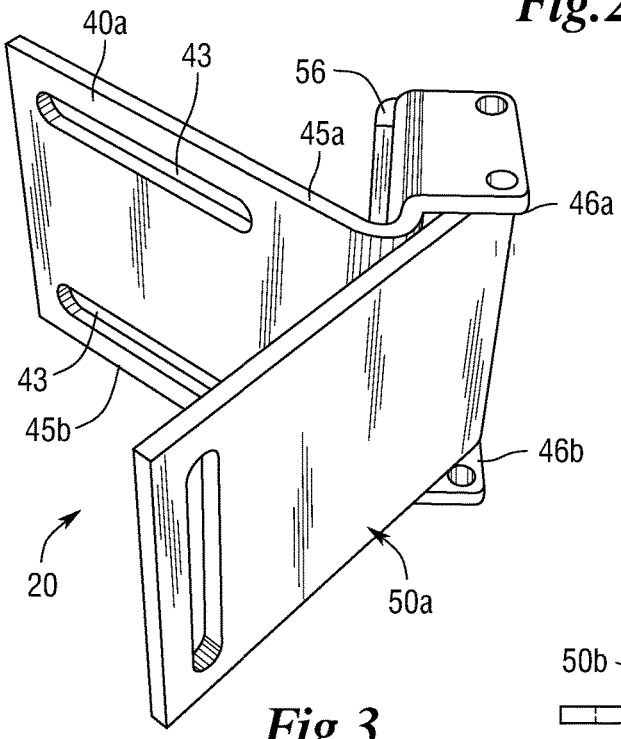
FIG. 3 is an rear perspective view of the first embodiment of securement bracket.
Figure 4:
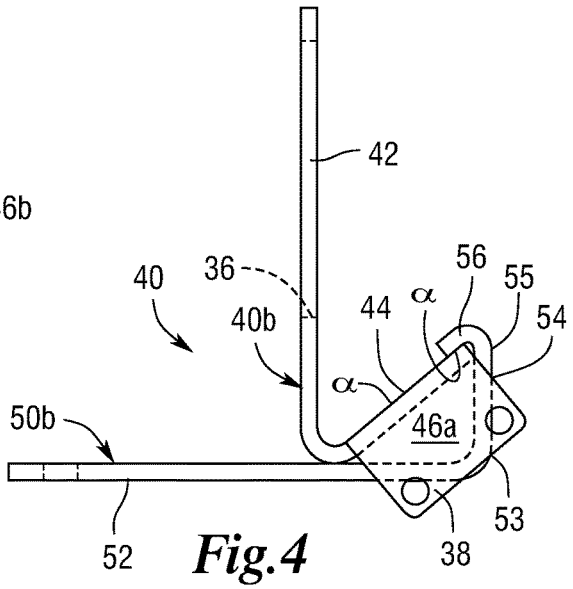
FIG. 4 is a top view of the first embodiment of the securement bracket.
Figure 5:
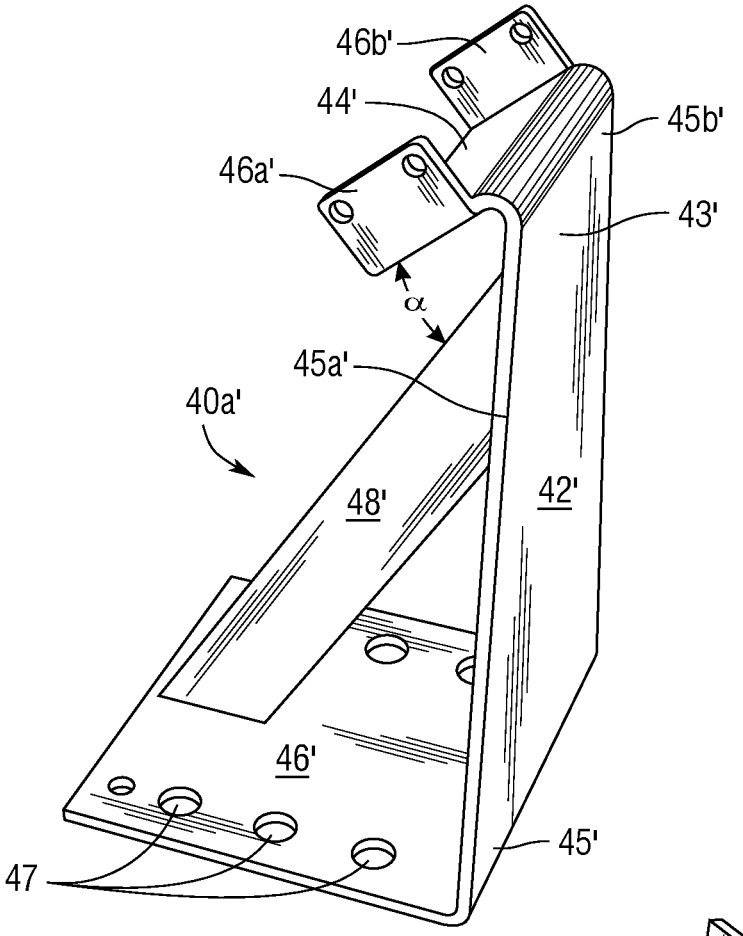
FIG. 5 is a side perspective view of a stationary member of a second embodiment of securement bracket.
Figure 6:
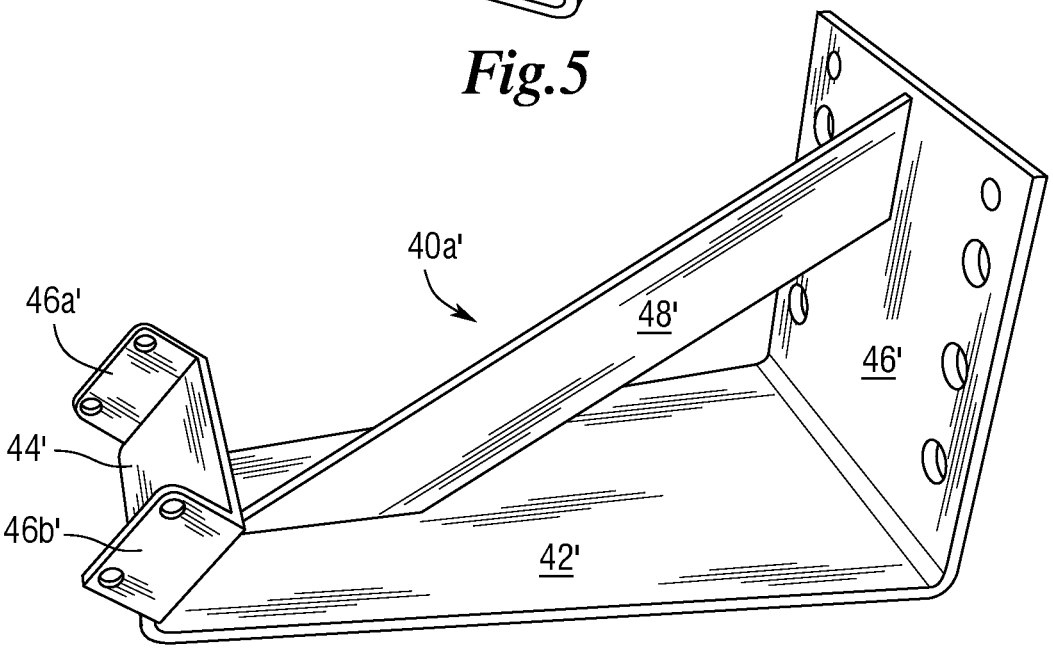
FIG. 6 is a side perspective view of the second embodiment with the stationary member of the bracket lying down.
Figure 7:
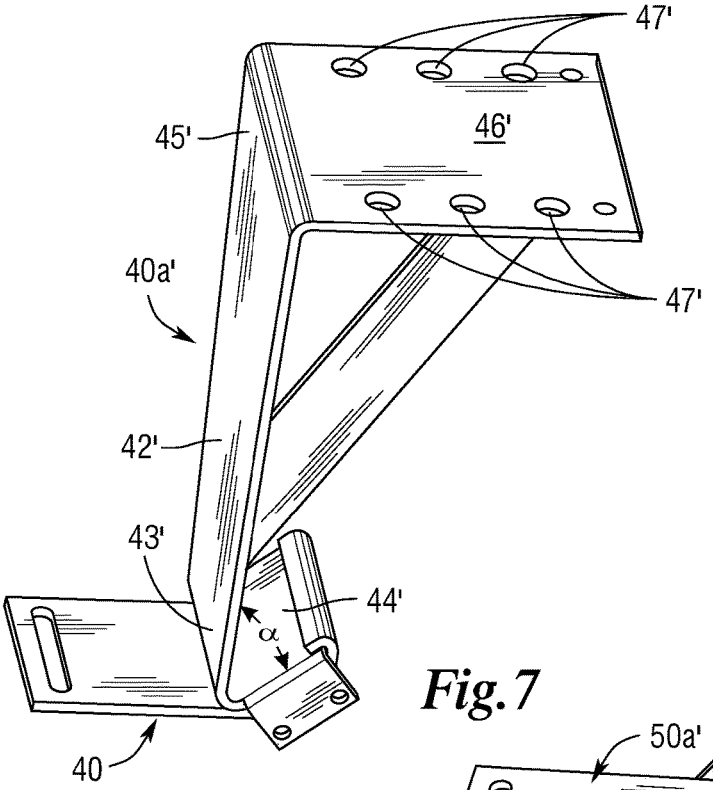
FIG. 7 is a side perspective view of the second embodiment with both halves engaged.

The first embodiment of attachment means 40 featuring connectors 40*a*, 40*b* and clips 50*a*, 50*b* are detailed in FIGS. 2-4. Connector or bracket 40*a*, 40*b* consists of a first planar portion 42 with a plurality of attachment slots or openings 43 and a second planar portion 44 forming an angle α with first planar portion 42 at a first end 41*a* thereof. A pair of ears 46*a*, 46*b* extend from an upper and lower edge 45*a*, 45*b*, respectively of second planar portion 44 and serve to stabilize clips 50, 50*b* when engaged therewith. Connectors 40*a*, 40*b* are designed to be bolted to overhead door rails 60, 62 (FIG. 2).

Each of clips 50*a*, 50*b* comprises a first planar member 52 and a second orthogonal arm member 54. First planar member 52 extends from a first end 53 of second orthogonal arm member 54 which third angulated member 56 extends from the opposite end 55 of second orthogonal arm member 54 at an angle α. When clip 50*a*, 50*b* is engaged with connector 40*a*, 40*b*, first planar member 52 forms a right angle with first planar portion 42 (see FIG. 4).

Figure 8:
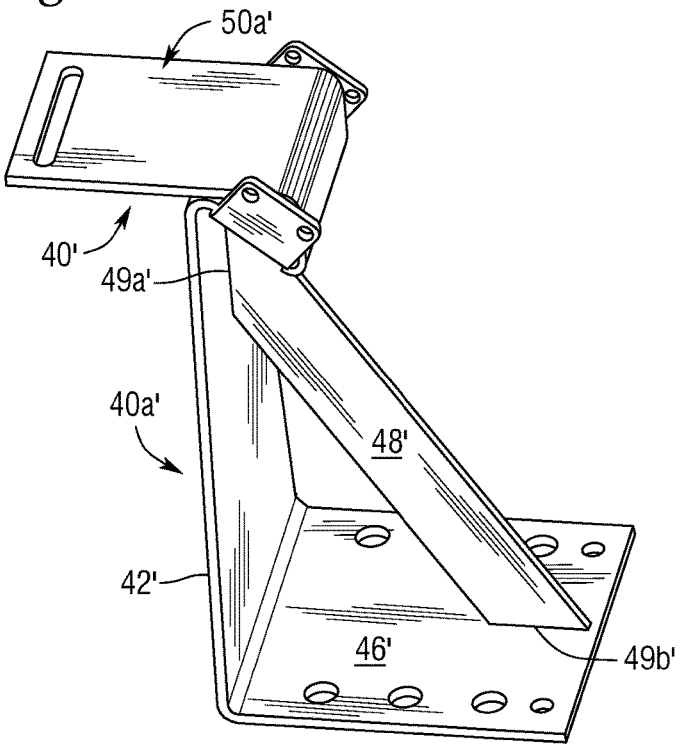
FIG. 8 is an inverted side perspective view of the second embodiment with both halves of the bracket engaged.

Not all overhead door rails have sufficient rigidity to adequately support connectors 40*a*, 40*b* and the associated safety net system 20. For other non-overhead door applications, such rails are not available. Second embodiment 40' shown in FIGS. 5-8 have a more robust design. Attachment means 40' utilizes the same clips 50*a*, 50*b* as the previous embodiment but beefed up connectors 40*a*', 40*b*'. As with the first embodiment, first planar portion 42' has a second planar portion 44' extending from first end 43' forming an angle α' therewith. Third planar portion 46' extends from second end 45' and has a plurality of attachment openings 47' which permit bracket 40' to be bolted directly to a wall, column, beam or the like. Ears 46*a*', 46*b*' extend from upper and lower edges 45*a*' and 45*b*' of second planar portion 44', respectively. Reinforcement bar 48' is welded at first end 49*a*' to first planar portion 42' and at second end 49*b*' to third planar portion 46' (FIG. 8).

Figure 9:
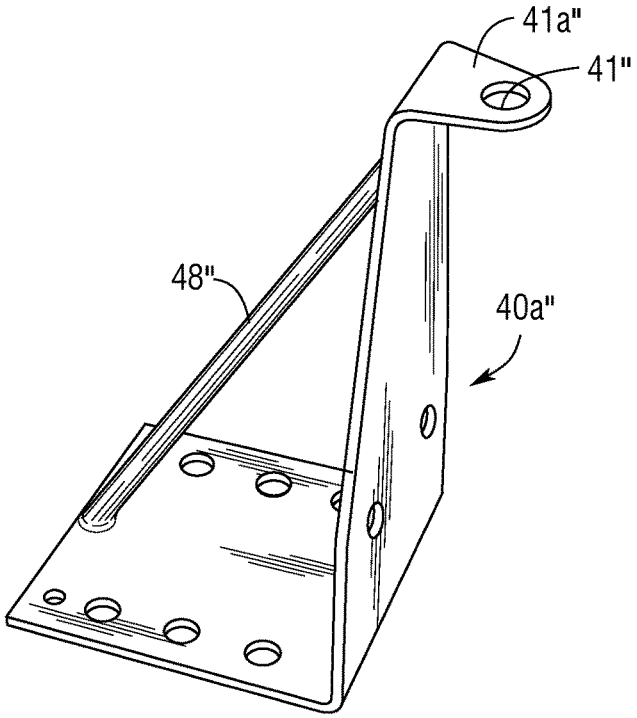
FIG. 9 is a side perspective view of a third embodiment of attachment bracket; and, FIG. 10 is a partial front view showing a modified connector and stanchion.

Third embodiment 40*a*" of bracket is shown in FIG. 9. This design is similar to second embodiment 40' with the exception that the flate plate of the previous embodiment is replaced with circular bar 48" and an eyelet 41" is formed in finger 41*a*" to facilitate connection with a conventional spring clip 50" shown in the FIG. 10 embodiment.

Yet another embodiment of safety net system 20" is depicted in FIG. 10. As depicted in this embodiment, strap extensions 38" are only formed on some of the horizontal strap members 32". Each of the extensions 38" are provided with adjustment clips 70" which permit the length of extensions 38" and therefore, the tension of safety net 20" to be adjusted. As an alternative to the clips 50*a*, 50*b* shown in the earlier embodiment, this embodiment utilizes a conventional spring clip 50" which engages eyelet 40" which extends from a side surface 82" of stanchion 80". Stanchion 80" includes a base 84" which may be bolted to the floor, base 84" including a stump 86" extending upwardly from the upper surface 85" of base 84". Removable upper post 88" fits over stump 86" and is secured thereto by a pull pin 89" in one of a series of holes in stump 86" making stanchion 80" adjustable in height. Further, should a wide load extending over the sides of a fork lift need to be shuttled to or from a loading bay, upper post 88" can be removed so that it does not interfere with the movement of the oversized load.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A safety net system for limiting pedestrian and vehicular traffic to a dangerous area, said safety net system comprising:

a) a first fixed support positioned adjacent a first side of the dangerous area, said first fixed support having a first group of connectors attached thereto, each one of said first group of connectors comprising a first bracket having a first planar portion and a second planar portion forming an angle α with said first planar portion, each said first bracket having a pair of ears, one extending from an upper edge of said second planar portion and a second extending from a lower edge of said second planar portion;

b) a second fixed support positioned adjacent a second side of the dangerous area, said second fixed support having a second group of connectors attached thereto, each one of said second group of connectors comprising a second bracket having a third planar portion and a fourth planar portion forming an angle α with said third planar portion, each said second bracket having a pair of ears, one extending from an upper edge of said fourth planar portion and a second extending from a lower edge of said fourth planar portion;

c) a removable mesh net extendable between said first fixed support and said second fixed support, said removable mesh net having a first series of clips engagable with said first group of connectors, each one of said first series of clips having a first planar member, a second orthogonal arm member, and a third angulated member, wherein said third angulated member forms an angle α with said second orthogonal arm member, and a second series of clips engagable with said second group of connectors, each one of said second series of clips having a fourth planar member, a fifth orthogonal arm member, and a sixth angulated member, wherein said sixth angulated member forms an angle α with said fifth orthogonal arm member, whereby when said first and second series clips engage said first and second brackets of said first and second groups of connectors, said third and sixth angulated members wrap around end portions of said second and fourth planar portions between said pairs of ears securing said first and second groups of clips to said first and second brackets of said first and second groups of connectors, said pairs of ears of said first and second brackets stabilizing said clips securing said clips to said connectors in a manner to limit access to the dangerous area and prevent unwary pedestrians and vehicle drivers from possibly being injured.

2. The safety net system of claim 1 wherein said removable mesh net comprises orthogonal woven horizontal and vertical strap members and said first group of clips are each secured to one of a first series of strap extensions protruding laterally from a first edge of said removable mesh net and said second group of clips are each secured to one of a second series of strap extensions protruding laterally from a second opposite edge of said removable mesh net.

3. The safety net system of claim 2 wherein a length of each of said first and second series of strap extensions is adjustable.

4. The safety net system of claim 1 further comprising an additional planar portion at a second opposite end of said first planar portion.

5. The safety net system of claim 4 wherein said additional planar portion includes a plurality of attachment openings for securing said first bracket to said first fixed support.

6. The safety net system of claim 4 further comprising a stabilization bar welded at each end to said first planar portion and said additional planar portion.

7. A safety net system for limiting pedestrian and vehicular traffic to a dangerous area, the dangerous area having a first fixed support adjacent a first side and a second fixed support adjacent a second opposite side, said safety net system comprising:

a) a first group of connectors configured to be attached to the first fixed support, each one of said first group of connectors comprising a first bracket having a first planar portion and a second planar portion forming an angle α with said first planar portion, each said first bracket having a pair of ears, one extending from an upper edge of said second planar portion and a second extending from a lower edge of said second planar portion;

b) a second group of connectors configured to be attached to the second fixed support, each one of said second group of connectors comprising a second bracket having a third planar portion and a fourth planar portion forming an angle α with said third planar portion, each said second bracket having a pair of ears, one extending from an upper edge of said fourth planar portion and a second extending from a lower edge of said fourth planar portion;

c) a removable mesh net extendable between said first group of connectors and said second group of connectors, said removable mesh net having a first series of clips engagable with said first group of connectors, each one of said first series of clips having a first planar member, a second orthogonal arm member, and a third angulated member, wherein said third angulated member forms an angle α with said second orthogonal arm member, and a second series of clips engagable with said second group of connectors each one of said second series of clips having a fourth planar member, a fifth orthogonal arm member, and a sixth angulated member, wherein said sixth angulated member forms an angle α with said fifth orthogonal arm member, whereby when said first and second series clips engage said first and second brackets of said first and second groups of connectors, said third and sixth angulated members wrap around end portions of said second and fourth planar portions between said pairs of ears securing said first and second groups of clips to said first and second brackets of said first and second groups of connectors, said pairs of ears of said first and second brackets stabilizing said clips securing said clips to said connectors in a manner to limit access to the dangerous area and prevent unwary pedestrians and vehicle drivers from incurring possible injuries.

8. The safety net system of claim 7 wherein said removable mesh net comprises orthogonal woven horizontal and vertical strap members and said first group of clips are each secured to one of a first series of strap extensions protruding laterally from a first edge of said removable mesh net and said second group of clips are each secured to one of a second series of strap extensions protruding laterally from a second opposite edge of said removable mesh net.

9. The safety net system of claim 8 wherein a length of each of said first and second series of strap extensions is adjustable.

10. The safety net system of claim 8 wherein each of said first group of connectors further comprises an additional portion positioned at an opposite end of said first planar portion from said second planar portion, said additional planar portion extending orthogonally from said first planar portion.

11. The safety net system of claim 10 further comprising a stabilization bar welded at each end to said first planar portion and said additional planar portion.

* * * * *